US006426598B1

(12) United States Patent
Kataja

(10) Patent No.: US 6,426,598 B1
(45) Date of Patent: Jul. 30, 2002

(54) CONTROL GEAR FOR FLUORESCENT LAMP

(75) Inventor: Jari Kataja, Lahti (FI)

(73) Assignee: Teknoware Oy (FI)

( * ) Notice: Subject to any disclaimer, the term of this patent is extended or adjusted under 35 U.S.C. 154(b) by 0 days.

(21) Appl. No.: 09/701,638

(22) PCT Filed: Mar. 28, 2000

(86) PCT No.: PCT/FI00/00259

§ 371 (c)(1),
(2), (4) Date: Nov. 30, 2000

(87) PCT Pub. No.: WO00/59272

PCT Pub. Date: Oct. 5, 2000

(30) Foreign Application Priority Data

Mar. 31, 1999 (FI) ..... 990720

(51) Int. Cl.[7] ..... H05B 37/02

(52) U.S. Cl. ..... 315/224; 315/291; 315/209 R; 315/105; 315/57; 315/274

(58) Field of Search ..... 315/224, 225, 315/291, 307, 209 R, 219, 105, 106, 107, 57, 274

(56) References Cited

U.S. PATENT DOCUMENTS

| | | | | |
|---|---|---|---|---|
| 5,801,491 A | | 9/1998 | Canova | 315/224 |
| 6,118,223 A | * | 9/2000 | Canova | 315/244 |

FOREIGN PATENT DOCUMENTS

| | | |
|---|---|---|
| EP | 0391360 | 10/1990 |
| FI | 91120 | 1/1994 |
| FI | 96160 | 1/1996 |

* cited by examiner

*Primary Examiner*—Don Wong
*Assistant Examiner*—Tuyet T. Vo
(74) *Attorney, Agent, or Firm*—Leydig, Voit & Mayer Ltd.

(57) ABSTRACT

A control gear for a fluorescent lamp, comprising a voltage source and an ignition and supply circuit comprising an inductive component and a capacitance. The control gear also comprises a transformer whose primary coil is connected parallel to the capacitance, and a switching element which is connected to the secondary coil of a transformer for short-circuiting it.

4 Claims, 1 Drawing Sheet

CONTROL GEAR FOR FLUORESCENT LAMP

BACKGROUND OF THE INVENTION

The present invention relates to a control gear for a fluorescent lamp, comprising a voltage source and an ignition and supply circuit comprising an inductive component and a capacitance.

Fluorescent lamps are generally used owing to their good lighting power. In addition, the long operating life of fluorescent lamps and the various tones of color available enable their use in various applications.

A control gear is required for burning fluorescent lamps, the control gear supplying the ignition voltage necessary for the fluorescent lamp and the supply voltage necessary during its use. When using electronic control gears, a problem arises from the fact that a lamp circuit has very high voltages which set extremely high demands on the switches used in the lamp circuit. Due to the high voltage levels, it is possible that the lamp ignites prematurely before the electrodes of the lamp are heated enough. This may lead to quick wear of the electrodes and uncertain ignition. In addition, in present prior art solutions, there are significant problems in the control of the switches in the lamp circuit and in determining the working condition of the lamp, which are due to said high voltage levels.

When a long ignition durability is required in fluorescent lamps, they should be ignited so that heating voltage is first switched on in the heater circuits for approximately one second so that they will reach the temperature required for a thermal electron emission. Only after this, an ignition voltage is switched on over the lamp, generating an arc discharge in the filler gas of the fluorescent lamp.

The above-mentioned function can also be performed by preventing the fluorescent lamp from igniting during preheating by short-circuiting it with a switch. The conventional use of a series choke and a glow discharge igniter in 50 Hz mains voltage use, for instance, is based on this method.

The problem in this case is that the used switch is greatly loaded due to the high voltages in the lamp circuit. Another drawback in the solution in question is that the switch over the lamp and its control electronics cannot be galvanically separated from the high-voltage lamp circuit.

BRIEF DESCRIPTION OF THE INVENTION

It is an object of the present invention to provide a control gear for a fluorescent lamp, which avoids the above drawbacks and makes it possible to keep the fluorescent lamp unignited during preheating of the electrodes and to measure the voltage over the lamp with a simple apparatus while the lamp is operational. This object is achieved by a fluorescent lamp control gear of the invention, characterized in that the control gear also comprises a transformer whose primary coil is connected parallel to a capacitance, and a switching element which is connected to the secondary coil of the transformer for short-circuiting it.

The control gear of the invention is based on the idea that by adding to the lamp circuit a transformer connection whose secondary coil can be opened and shut with a switch, it is possible to ensure that the preheating of the fluorescent lamp is long enough. The transformer connection also makes it possible to monitor the condition of the fluorescent lamp in a simple manner by monitoring the magnitude of the voltage in the secondary coil of said transformer.

The fluorescent lamp control gear of the invention provides significant advantages with respect to the reliability of the lamp ignition, because the preheating of the fluorescent lamp is arranged by means of the control gear of the invention so that the lamp cannot ignite before the electrodes are heated. Another significant advantage provided by the control gear is the possibility to monitor the condition of the lamp by using simple voltage measurement from a voltage that is considerably lower than the actual voltage of the lamp circuit.

BRIEF DESCRIPTION OF THE FIGURES

In the following, the invention will be described by means of preferred embodiments and with reference to the attached drawings, in which.

DETAILED DESCRIPTION OF THE INVENTION

Figure 1:
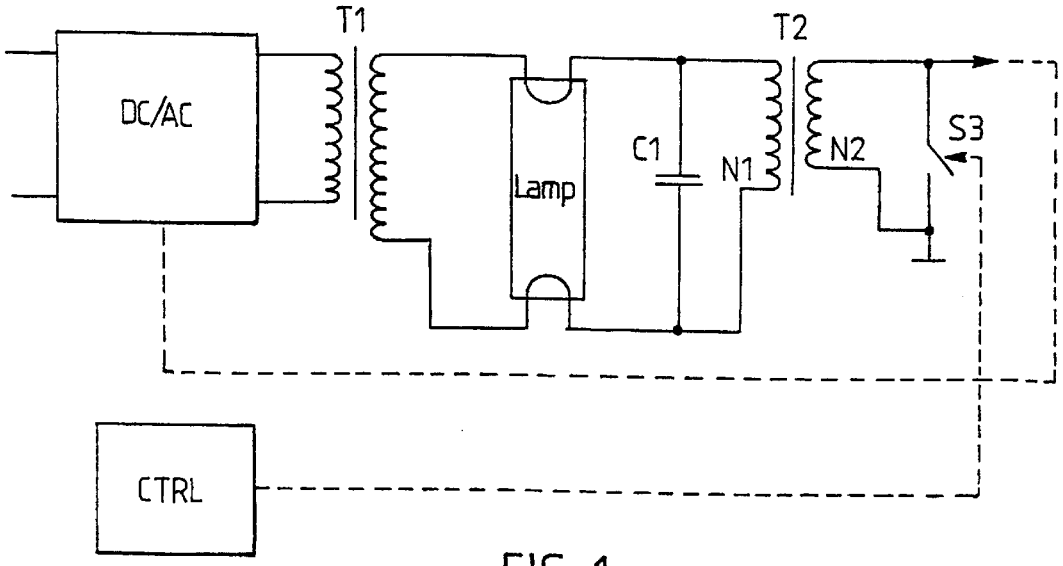
FIG. 1 shows a circuit diagram illustrating the principle of a control gear of the invention having a transformer feed.

In the embodiment of the invention shown in FIG. 1, the voltage feed of the lamp circuit is a DC/AC chopper to whose output the primary coil of a transformer T1 is connected. The secondary coil of the transformer T1 forms a part of the lamp circuit so that the secondary coil is connected parallel to a fluorescent lamp. A capacitance C1 is connected to the second poles of the fluorescent lamp electrodes as shown in the figure. The inductive component, i.e. the distributed inductance of the transformer T1, in FIG. 1 forms together with the capacitance C1 a resonant circuit enabling the generation of the voltage required to ignite the fluorescent lamp.

According to the invention, a transformer T2 is connected parallel to the capacitance C1 of the lamp circuit. The primary coil N1 of the transformer T2 is connected to the second poles of the capacitance and the Lamp According to the invention, a switching element S3 for opening and closing the secondary circuit of the transformer is connected to the secondary coil of the transformer. A control block Ctrl is arranged to control the switching element S3.

Figure 2:
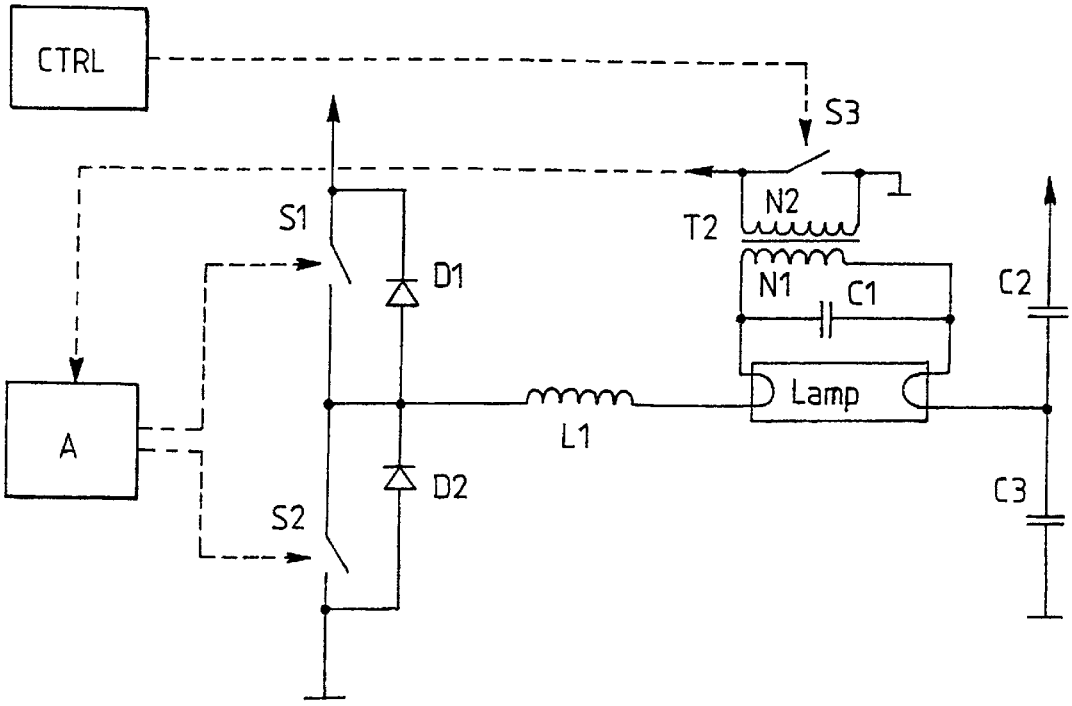
FIG. 2 shows a circuit diagram illustrating the principle of a control gear of the invention having a half-bridge feed.

In the embodiment in FIG. 2, the voltage supply in the control gear of the invention is formed by a half-bridge connection made up of a control circuit A, switches S1, S2 and diodes D1, D2. Such a high-frequency half-bridge-connected chopper voltage source enables the supply of alternating voltage to the lamp circuit in a simple manner. In a half-bridge connection, the state of the switches S1, S2 is changed at a high frequency to achieve the desired voltage to burn the fluorescent lamp. By changing the pulse ratios of the switches, the magnitude of the voltage fed to the fluorescent lamp can be altered. According to the invention, an inductive component L1 is connected to the half-bridge output, i.e. to the point between the switches S1, S2 and the diodes D1, D2. In the embodiment of the invention in FIG. 2, the inductive component L1 is an inductance which forms a series choke for the fluorescent lamp Lamp. The second pole of the inductance L1 is connected to the second electrode of the fluorescent lamp.

According to the invention, a capacitance C1 and, parallel to it, the primary coil N1 of the transformer T2 are connected between the second poles of the fluorescent lamp electrodes. According to the invention, the switching element S3, which is controlled by the control block Ctrl, is connected to the secondary coil of the transformer T2. The inductance L1 and the capacitance C1 form a series-resonant circuit with which the voltage required for igniting the fluorescent lamp can be generated. In the embodiment of FIG. 2, the second pole of the second electrode in the fluorescent lamp is connected to the point between the capacitances C2 and C3. The second poles of the capacitances connected in series are connected to the operating voltage and zero potential.

The operating principle of the control gear of the invention is that when the gear is switched on, a power unit supplies a voltage having a suitable frequency in comparison with the resonance frequency of the inductive component L1 and the capacitance C1 in the control gear. During preheating, the switching element S3 of the transformer T2 secondary coil is closed so that the transformer loads the lamp circuit and a preheating current, which is considerably higher than in normal use, flows through the lamp electrodes, and no voltage resonance can generate in the resonant circuit. The preheating stage of the lamp, i.e. the time during which the switching element is kept closed, lasts approximately one second to allow the temperature of the electrodes to rise sufficiently high for the generation of a thermal electron emission.

When the preheating stage is over, the switching element S3 connected to the secondary coil of the transformer T2 is opened, whereby a resonance voltage is generated in the resonant circuit formed by the inductive component Li and the capacitance C1 and the fluorescent lamp connected to the lamp circuit can be ignited. The transformation ratio of the transformer T2 is designed in such a manner that the number of coil turns N2 in its secondary coil is considerably smaller than the number of coil turns N1 in the primary coil. This way, a switch having a low voltage tolerance can be used as the preheating switch, i.e. the switching element S3.

After the preheating switch has opened, the state of the fluorescent lamp connected to the lamp circuit can be monitored by measuring the voltage in the secondary coil of the preheating transformer T2. Due to the transformation ratio of the transformer, the voltage measured from the secondary coil is low. In the embodiments of the figures, the voltage data is transmitted to the control electronics which perform the necessary control action on the basis of the transmitted data. It is easy to determine the working condition of the fluorescent lamp being controlled from the level of the voltage measured from the secondary coil of the transformer T2. When the measured voltage exceeds a predefined value, the lamp does not ignite. If the voltage is zero, either the heater circuit of the lamp is broken or there is a break in the wiring of the lamp. In both above-mentioned cases, the chopper supplying the voltage can be switched off.

It is obvious to a person skilled in the art that the basic idea of the invention can be implemented in many different ways. Thus, the invention and its embodiments are not restricted to the examples described above, but may vary within the scope of the claims.

What is claimed is:

1. A control gear for a fluorescent lamp having a preheating phase and a lamp voltage, said control gear comprising:

a voltage source, an ignition and supply circuit comprising an inductive component and a capacitance, a first transformer having a primary coil and a secondary coil, said primary coil being connected parallel to the capacitance, and said primary coil being connected directly in parallel with the lamp, and a switching element connected to the secondary coil of said transformer for short-circuiting said secondary coil during the preheating phase of the lamp and for opening said secondary coil after the preheating phase.

2. A control gear as claimed in claim 1, characterized in that the inductive component is an inductance.

3. A control gear as claimed in claim 1, characterized in that the inductive component is a second transformer.

4. A control gear for a fluorescent lamp having a preheating phase and a lamp voltage, said control gear comprising:

a voltage source, an ignition and supply circuit comprising an inductive component and a capacitance, a first transformer having a primary coil and a secondary coil, said primary coil being connected parallel to the capacitance, a switching element connected to the secondary coil of said transformer for short-circuiting said secondary coil during the preheating phase of the lamp and for opening said secondary coil after the preheating phase, and said secondary coil having a voltage proportional to said lamp voltage after the preheating phase whereby monitoring the secondary coil voltage provides an indication of a working condition of the lamp.

* * * * *